US011305845B2

(12) United States Patent
Hawthorne

(10) Patent No.: US 11,305,845 B2
(45) Date of Patent: Apr. 19, 2022

(54) STAND-UP INFLATABLE PADDLE BOARD

(71) Applicant: Red Paddle Co Limited, Totnes (GB)

(72) Inventor: Philip Thomas Hawthorne, Modbury (GB)

(73) Assignee: Red Paddle Co Limited, Totnes (GB)

( * ) Notice: Subject to any disclaimer, the term of this patent is extended or adjusted under 35 U.S.C. 154(b) by 0 days.

(21) Appl. No.: 16/965,708

(22) PCT Filed: Jan. 28, 2019

(86) PCT No.: PCT/GB2019/000009
§ 371 (c)(1),
(2) Date: Jul. 29, 2020

(87) PCT Pub. No.: WO2019/150063
PCT Pub. Date: Aug. 8, 2019

(65) Prior Publication Data

US 2021/0039753 A1 Feb. 11, 2021

(30) Foreign Application Priority Data

Feb. 2, 2018 (GB) ..... 1801794

(51) Int. Cl.
*B63B 32/51* (2020.01)
*B63B 3/48* (2006.01)
*B63B 21/04* (2006.01)

(52) U.S. Cl.
CPC ..... *B63B 32/51* (2020.02); *B63B 3/48* (2013.01); *B63B 21/04* (2013.01)

(58) Field of Classification Search
CPC ..... B63B 32/51; B63B 3/48; B63B 21/04
See application file for complete search history.

(56) References Cited

U.S. PATENT DOCUMENTS

| | | | | |
|---|---|---|---|---|
| 9,751,599 | B1 * | 9/2017 | Ebrahimi | B63B 32/51 |
| 9,908,595 | B1 * | 3/2018 | Kokinelis | F16K 11/00 |
| 10,086,918 | B2 * | 10/2018 | Pepper | B63B 32/51 |
| 2005/0023177 | A1 * | 2/2005 | Kiger | B63B 32/87 206/522 |
| 2009/0049757 | A1 * | 2/2009 | Potter | B63B 32/51 441/74 |

(Continued)

OTHER PUBLICATIONS

Written Opinion of the International Application No. PCT/GB2019/000009 dated May 22, 2019, five (5) pages.

*Primary Examiner* — S. Joseph Morano
*Assistant Examiner* — Jovon E Hayes
(74) *Attorney, Agent, or Firm* — Iandiorio Teska & Coleman, LLP

(57) ABSTRACT

A stand-up inflatable paddle board (2) comprising (i) a deck (4); (ii) a valve (6) for enabling the stand-up inflatable paddle board (2) to be inflated and deflated; (iii) indicator means (12) for indicating that the stand-up inflatable paddle board (2) requires at least one fold which is longitudinal when the stand-up inflatable paddle board (2) is to be placed in a deflated condition; and (iv) at least one deck pad (8, 10) which extends longitudinally of the deck (4) and which is for receiving a user of the stand-up inflatable paddle board (2), and the stand-up inflatable paddle board (2) being such that (v) the deck pad (8, 10) causes the stand-up inflatable paddle board to have a gap (14) which permits the fold to be effected about the gap (14).

18 Claims, 8 Drawing Sheets

(56) References Cited

U.S. PATENT DOCUMENTS

| | | | | |
|---|---|---|---|---|
| 2013/0065463 | A1* | 3/2013 | Chou | B63B 32/57<br>441/74 |
| 2014/0080369 | A1* | 3/2014 | Haller | B63B 32/51<br>441/66 |
| 2021/0039753 | A1* | 2/2021 | Hawthorne | B63B 3/48 |

* cited by examiner

STAND-UP INFLATABLE PADDLE BOARD

This invention relates to a stand-up inflatable paddle board and, more especially, this invention relates to a stand-up inflatable paddle board for a single user.

Stand-up inflatable paddle boards for single users are well known. When they are not being used, they are deflated to a deflated condition and then they are folded or rolled up. The folding or rolling takes place such that the folds or rolls are transverse to the length of the paddle board. In the deflated condition, the known stand-up inflatable paddle boards are bulkier than would be preferred.

It is an aim of the present invention to reduce the above mentioned problem.

Accordingly, the present invention provides a stand-up inflatable paddle board which is for a single user and which comprises:

(i) a deck;

(ii) a valve for enabling the stand-up inflatable paddle board to be inflated and deflated;

(iii) indicator means for indicating that the stand-up inflatable paddle board requires at least one fold which is longitudinal when the stand-up inflatable paddle board is to be placed in a deflated condition; and (iv) at least one pair of deck pads for receiving the user of the stand-up inflatable paddle board, and wherein the deck pads extend longitudinally of the deck, and the stand-up inflatable paddle board being such that:

(v) the deck has a too side and an underside;

(vi the top side and the underside are such that water cannot pass through the deck from the underside to the top side;

(vii) the deck has a front portion which curves upwardly in use of the stand-up inflatable paddle boar; and (viii) the deck pads are spaced apart by a longitudinal gap which permits the fold to be effected about the gap.

The stand-up inflatable paddle board of the present invention is advantageous in that the fold for placing the stand-up inflatable paddle board in the deflated condition is a longitudinal fold. Thereafter the stand-up inflatable paddle board can be folded or rolled with transversely extending folds or rolls. The result of having the longitudinal fold is that the stand-up inflatable paddle board is less bulky than the known stand-up inflatable paddle boards when folded or rolled only with transverse folds or rolls. The stand-up inflatable paddle board of the present invention is thus able to be more compact in the deflated condition, which in turn is very convenient for storage and also for carrying by users to and from use areas.

The gap is typically of a cross-sectional construction that permits the longitudinal fold easily to be made, and with a substantially less tendency of the folded stand-up inflatable paddle board to spring open to an unfolded condition than would be the case without the gap. Without the cross-sectional construction of the gap, the deck of the stand-up inflatable paddle board may tend to crease if folded longitudinally, and this is aesthetically and structurally undesirable. The cross-sectional construction may be formed by removing, for example by planing, material from a single large deck pad in order to form the two separate deck pads, or in order to form a single large deck pad with a longitudinally extending groove which forms the gap.

In one embodiment, the stand-up inflatable paddle board is one in which there is one pair of the deck pads, and in which the gap extends along a longitudinal central axis of the stand-up inflatable paddle board. The fold then places two longitudinally extending halves of the stand-up inflatable paddle board on top of each other. If desired however, the gap could be off-centre, in which case one longitudinally folded half would be wider than the other longitudinally folded half.

In another embodiment, the stand-up inflatable paddle board is one in which there are two pairs of the deck pads, and in which the two pairs of the deck pads are symmetrically disposed about a longitudinally central axis of the stand-up inflatable paddle board. Such an arrangement may give first, second and third fold lines, with the first pair of deck pads being foldable on top of one another about a first longitudinal fold line, the second pair of deck pads being foldable on top of one another about a second longitudinal fold line, and the folded first and second pairs of deck pads then being foldable on top of each other about a third longitudinal fold line. The third longitudinal fold line may typically be along the symmetrical centre line of the stand-up inflatable paddle board.

The stand-up inflatable paddle board may be one in which the indicator means is on the deck. The indicator means may be positioned elsewhere on the stand-up inflatable paddle board if desired.

Advantageously, the gap may be configured to form the indicator means. Thus, with a pair of relatively long deck pads, the gap between the deck pads forms an intuitive indicator means as to where the fold should be made. Additionally or alternatively, the indicator means may include signs, for example a single longitudinally extending line and/or inwardly facing arrows. Other indicator signs may employed.

The stand-up inflatable paddle board may include auxiliary indicator means which is on an underside of the stand-up inflatable paddle board in use of the stand-up paddle board. In this case, the stand-up inflatable paddle board may be one in which the indicator means is on a top side of the stand-up inflatable paddle board, and in which the auxiliary indicator means on the underside of the stand-up paddle board is in line with the indicator means. Other relative positions for the indicator means and the auxiliary indicator means may be employed. The auxiliary indicator means may be a peripheral gap between two components, a groove in a single component, or a sign such for example as a single longitudinally extending line, or a pair of spaced apart longitudinally extending lines. Other auxiliary indicator means may be employed.

The stand-up inflatable paddle board may include at least one stiffening member for stiffening the stand-up inflatable paddle board when it is in an inflated condition for use.

The stand-up inflatable paddle board may be one in which there is at least one of the stiffening members on a top side of the stand-up inflatable paddle board, and at least one of the stiffening members on an underside of the stand-up inflatable paddle board. By way of example, it is mentioned that there may be at least two of the stiffening members positioned one on either side of the indicator means. When there are one or more stiffening members on the underside of the stand-up inflatable paddle board, then there will usually be the same number of stiffening members of the underside of the stand-up inflatable paddle board as there are on the top side of the stand-up inflatable paddle board. Different numbers of stiffening members on the underside of the stand-up inflatable paddle board and the top side of stand-up inflatable paddle board may however be employed if desired. The or each stiffening member may be made of a flexible material. The stiffening members may be those known as stringers. The stiffening members may be made of the flexible material currently being used for known stringers. The flexible material enables the stand-up inflatable paddle board to be rolled up as and when desired.

The valve may be positioned on a left side of the deck. Alternatively, the valve may be positioned on a right side of the deck. The valve may be positioned where desired along the length of the deck, for example at a rear part of the deck. The valve may be positioned anywhere as desired and suitable on the stand-up inflatable paddle board. Thus, for example, the valve may be positioned on the rail or the bottom of the stand-up inflatable paddle board. The valve will normally be positioned such that it does not hinder folding.

The stand-up inflatable paddle board may include anchor means on the deck for enabling goods to be secured on the deck. The anchor means may be a plurality of eyelets. Other types of anchor means may be employed so that, for example, the anchor means may be a single eyelet or a formation which is not an eyelet. The anchor means is for receiving a tie such for example as a piece of string for being passed around products to be secured on the deck. The products may be equipment and/or clothing and/or food that might be needed during the use of the stand-up inflatable paddle board.

Preferably, the stand-up inflatable paddle board is made of a material known as drop stitch. Drop stitch is a material comprising two base fabrics connected with numerous strands of material called drop stitches. Both sheet materials are laminated with a plasticized polymer. The material is made into an airtight object by sealing the edges together using a secondary material, usually but not restricted to a material such as reinforced sheet polyvinyl chloride. The drop stitch base fabric is composed of high tensile fibers. This allows the stand-up inflatable paddle board to be inflated to a pressure adequate to create a rigid structure.

The deck pads may be made of ethylene vinyl acetate or polyurethane. Thermal polyurethane is able to give a soft feel and also is able to allow good folding and rolling. Other materials may be employed.

The stand-up inflatable paddle board may be one which includes a handle, and in which the handle is off-set from the fold.

The stand-up inflatable paddle board may include a pair of fins, and in which the fins are off-set from the fold. The stand-up inflatable paddle board may have any suitable number of fins, for example, one, two or three of the fins. The fins will normally be positioned such that they do not hinder the folding. Thus, usually, there will not be a fin or fins on any fold line.

Embodiments of the invention will now be described solely by way of example and with reference to the accompanying drawings in which.

Figure 1:
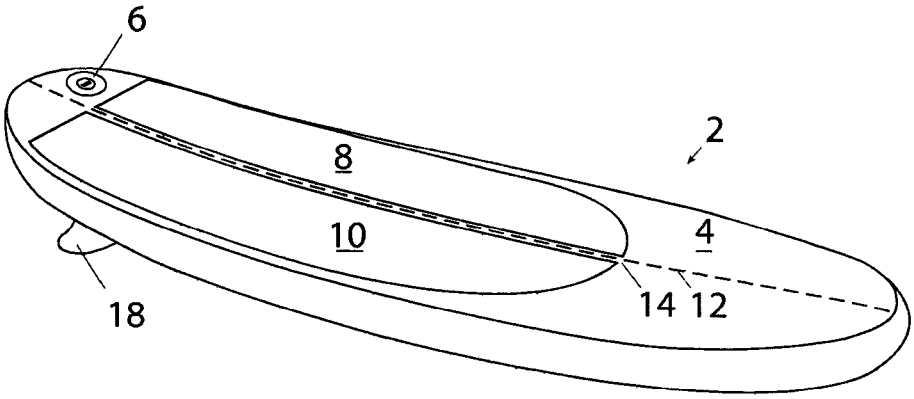
FIG. 1 is a perspective view from the front and one side of a first stand-up inflatable paddle board of the present invention.
Figure 2:
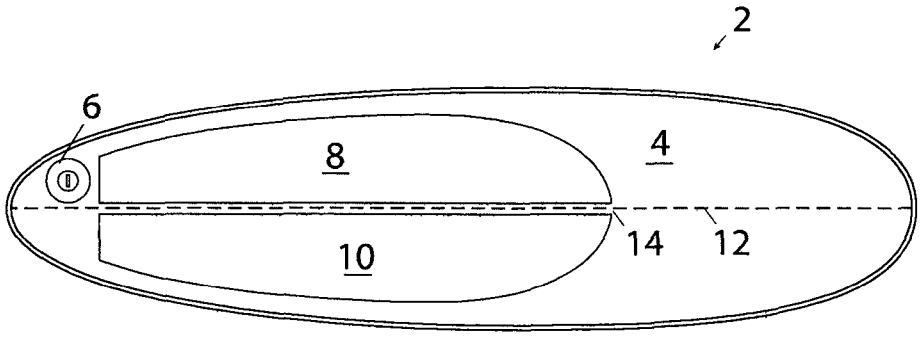
FIG. 2 is a top plan view of the stand-up inflatable paddle board shown in FIG. 1.
Figure 3:
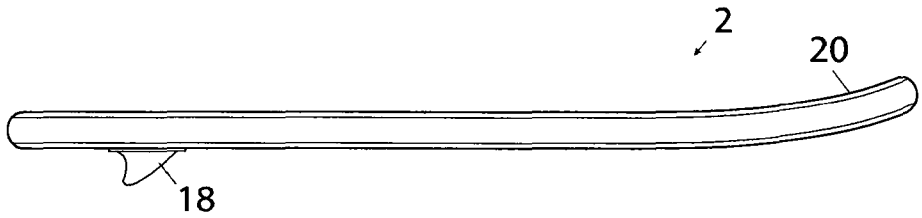
FIG. 3 is a side view of the stand-up inflatable paddle board shown in FIG. 1.

Referring to FIGS. 1-4, there is shown a stand-up inflatable paddle board 2 which is for a single user and which comprises a deck 4, and a valve 6 for enabling the stand-up inflatable paddle board 2 to be inflated and deflated.

A pair of deck pads 8, 10 extend longitudinally of the deck 4. The deck pads 8, 10 are for receiving the user of the stand-up inflatable paddle board 2. The user may stand or kneel on the deck pads 8, 10 as desired The stand-up inflatable paddle board 2 includes indicator means 12 for indicating that the stand-up inflatable paddle board 2 requires a fold which is longitudinal when the stand-up inflatable paddle board 2 is to be placed in a deflated condition. The pair of deck pads 8, 10 are spaced apart by a longitudinal gap 14. The gap 14 permits the told to be effected about the gap 14. Thus the fold takes place about the indicator means 12.

The indicator means 12 extends along a longitudinal central axis of the stand-up inflatable paddle board 2. The indicator means 12 is shown in FIG. 1 in the form of a broken line. If desired, the indicator means 12 could alternatively be simply the gap 14 between the deck pads 8, 10. Still further, in other embodiments of the invention, the indicator means 12 may be in the form of a broken line, or the indicator means 12 in the form of the gap 14 may be supplemented or replaced by other indicator means such for example as oppositely facing arrows indicating where the fold is to take place.

The stand-up inflatable paddle board 2 is such that the valve 6 is on a left side of the stand-up inflatable paddle board 2, and at a rear part of the stand-up inflatable paddle board 2. As can be seen from FIG. 4, the stand-up inflatable paddle board 2 has a pair of fins 16, 18. The fins 16,18 are mounted on mounting structures known as fin boxes. As can be seen from FIG. 3, the stand-up inflatable paddle board 2 has a front portion 20 which curves upwardly as shown.

Figure 4:
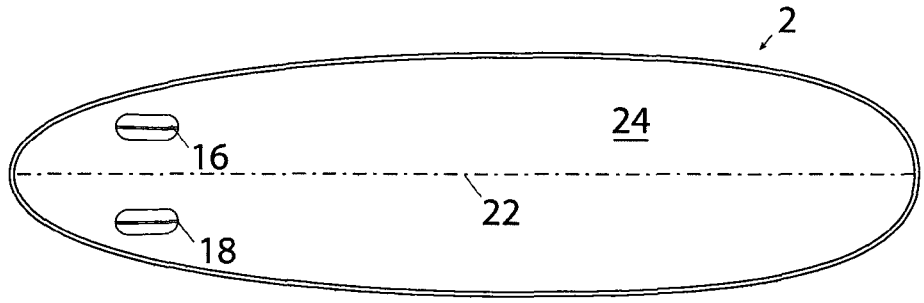
FIG. 4 is an underneath plan view of the stand-up inflatable paddle board shown in FIG. 1.

FIG. 4 shows an optional embodiment of the invention in which auxiliary indicator means 22 is provided. The auxiliary indicator means 22 is provided on an underside 24 of the stand-up inflatable paddle board 2 and is shown by a dotted and broken line. The auxiliary indicator means 22 is present on the stand-up inflatable paddle board 2 and is in addition to the indicator means 12 which then becomes the main indicator means 12. The auxiliary indicator means 22 is in line with, i.e. exactly below, the main indicator means 12 in use of the stand-up inflatable paddle board 2. Thus, if the stand-up inflatable paddle board 2 is facing upwardly or downwardly, there will always be an indicator means 12, 22 indicating that when the stand-up paddle board 2 is to be placed in a deflated condition, by example by folding or rolling, then what is initially required is the fold which is longitudinal and which is along the indicator means 12, 22.

With reference to FIG. 4, in a further optional embodiment of the invention, if there were to be two or more of the main indicator means such for example as the main indicator means 12, then there would typically be the same number of the auxiliary indicator means such for example as the auxiliary indicator means 22, positioned in line with, i.e. exactly below, the main indicator means in use of the stand-up inflatable paddle board 2. In the stand-up inflatable paddle board 2, the auxiliary indicator means may be regarded as being in line but spaced apart from the main indicator means.

Figure 5:
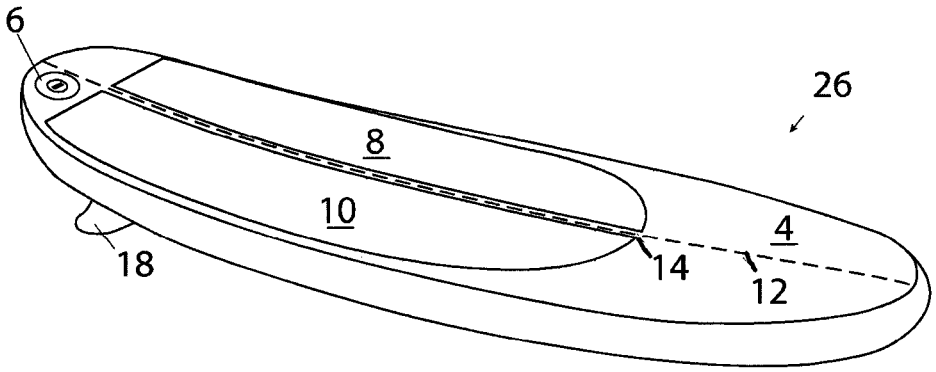
FIG. 5 is a perspective view from the front and one side of a second stand-up inflatable paddle board of the present invention.

Referring now to FIG. 5, there is shown a second stand-up inflatable paddle board 26. The stand-up inflatable paddle board 26 is like the stand-up inflatable paddle board 2. Similar parts have been given the same reference numerals for ease of comparison and understanding. In the stand-up inflatable paddle board 26, it will be seen that the valve 6 is on the right side of the deck 4 rather than the left side of the deck 4 as in the stand-up inflatable paddle board 2.

Figure 6:
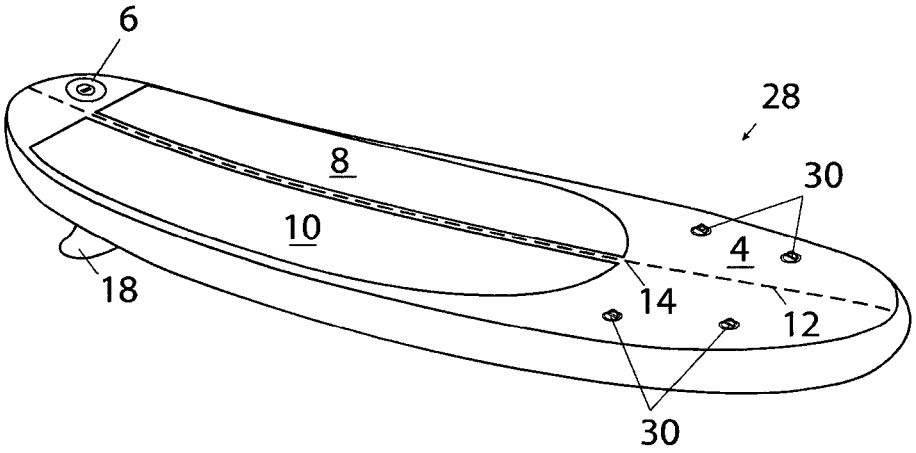
FIG. 6 is a perspective view from the front and one side of a third stand-up inflatable paddle board of the present invention.

Referring now to FIG. 6, there is shown a third stand-up inflatable paddle board 28. The stand-up inflatable paddle board 28 is like the stand-up inflatable paddle board 2. Similar parts have been given the same reference numerals for ease of comparison and understanding. The stand-up inflatable paddle board 28 is provided with four eyelets 30. These eyelets 30 may receive ties (not shown) for tying luggage onto the deck 4 of the stand-up inflatable paddle board 28.

Figure 7:
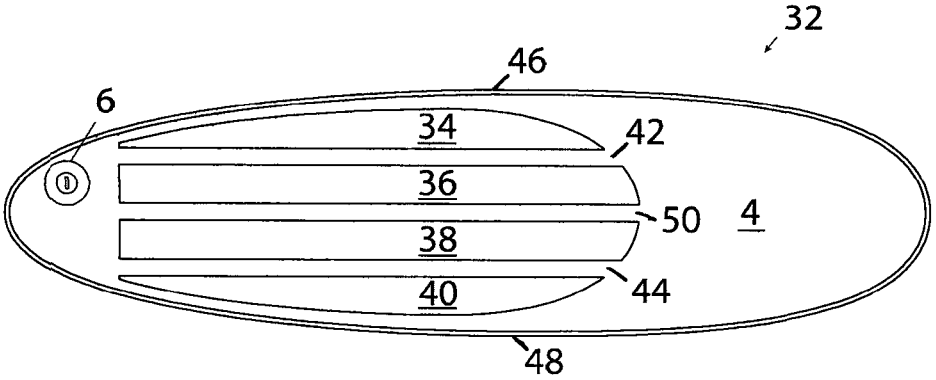
FIG. 7 is a top plan view of a fourth stand-up inflatable paddle board of the present invention.
Figure 8:
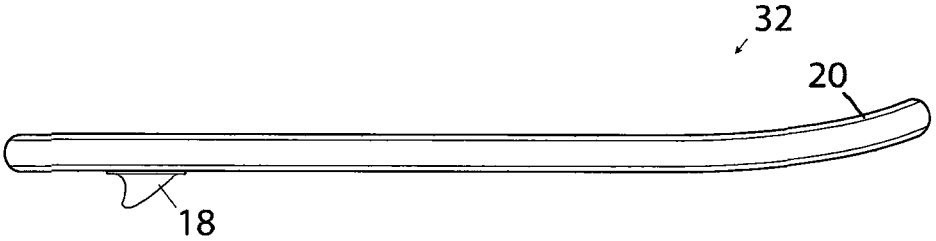
FIG. 8 is a side view of the stand-up inflatable paddle board shown in FIG. 7.
Figure 9:
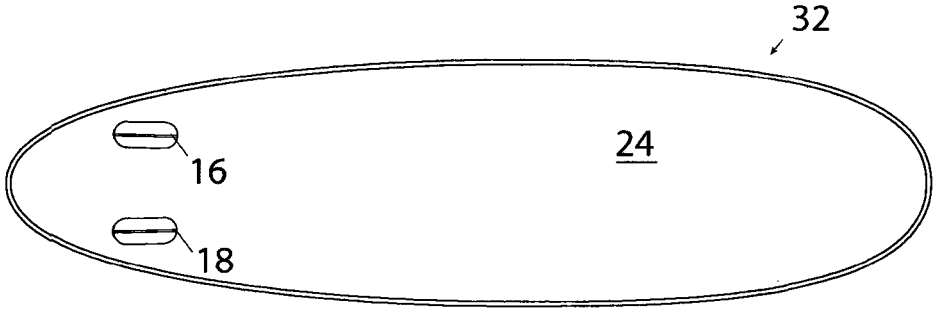
FIG. 9 is an underneath plan view of the stand-up inflatable paddle board shown in FIG. 7.
Figure 10:
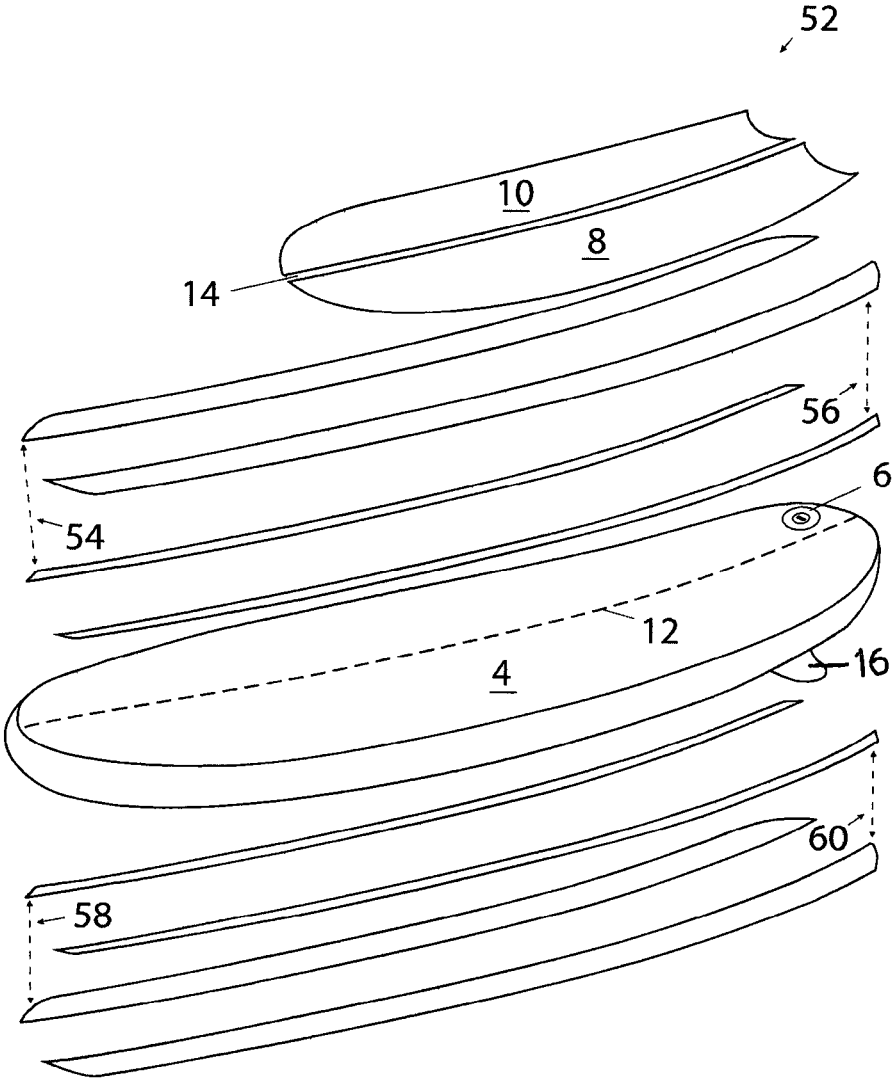
FIG. 10 is an exploded view of a fifth stand-up inflatable paddle board of the present invention.
Figure 11:
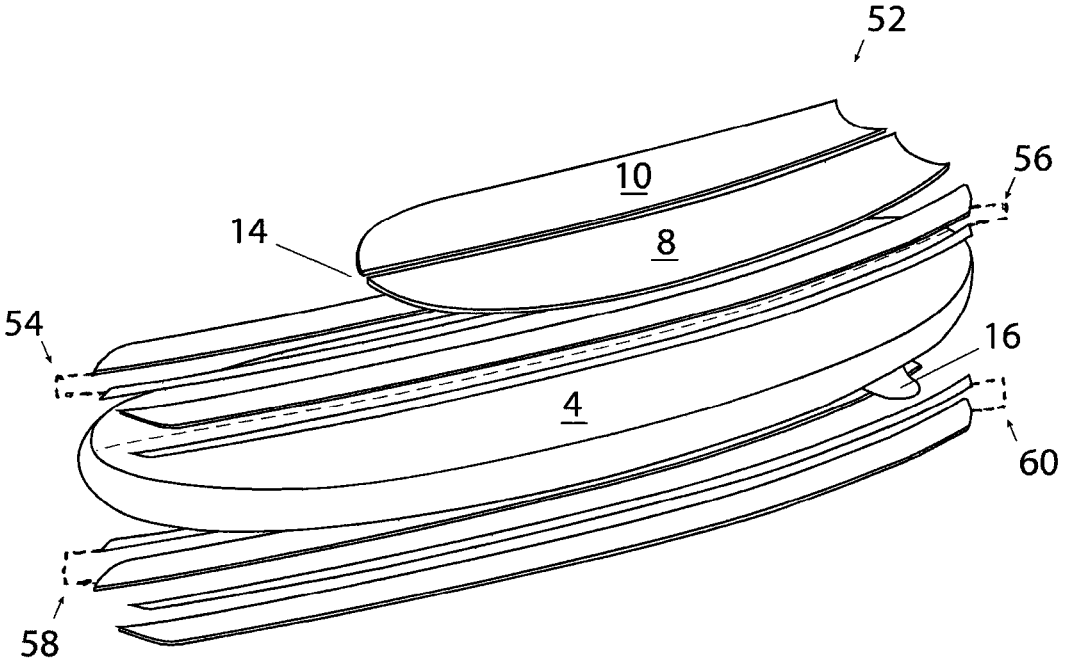
FIG. 11 is an exploded view like FIG. 10 but with the various component parts of the inflatable paddle board brought more closely together.

Referring now to FIGS. 7, 8 and 9, there is shown a fourth stand-up inflatable paddle board 32. Similar parts as in the stand-up inflatable paddle board 2 have been given the same reference numerals for ease of comparison and understanding. The stand-up inflatable paddle board 32 is provided with two pairs of deck pads, with the first deck pad pair being made up of deck pads 34, 36, and the second deck pad pair being made up of deck pads 38, 40. The deck pads 34, 36 are spaced apart by a gap 42. This gap 42 permits a longitudinal and first fold to be effected about the gap. The deck pads 38, 40 are spaced apart by a gap 44. This gap 44 permits a second fold to be effected about the gap 44. The first and second folds effected about the gaps 42, 44 are able to be made inwardly such that the opposing longitudinal edges 46, 48 of the stand-up inflatable paddle board 32 are folded inwardly and they lie in the gap 50 between the deck pads 36, 38. The stand-up inflatable paddle board 32 may then be rolled up, or it may be folded again about the gap 50 and then rolled up. In an alternative way of folding the stand-up inflatable paddle board 32, a user could simply fold the stand-up inflatable paddle board 32 once longitudinally about the gap 50. Thus the user is able to fold the stand-up inflatable paddle board 32 in different ways as may be determined as appropriate by the user. Also as determined as appropriate by the user, the user could make one single longitudinal fold about either the gap 42 or the gap 44. The fourth stand-up inflatable paddle board 28 is such that there are two pairs of the deck pads 34, 36 and 38, 40. The two pairs of the deck pads 34, 36 and 38, 40 are symmetrically disposed about a longitudinal central axis of the stand-up inflatable paddle board. The gap 50 is along the longitudinal central axis, and the gap 50 is also between the two pairs of the deck pads 34, 36 and 38, 40.

Referring now to FIGS. 10-13, there is shown a fifth stand-up inflatable paddle board 52. Similar parts as in the stand-up inflatable paddle board 2 have been given the same reference numerals for ease of comparison and understanding. The stand-up inflatable paddle board 52 is provided with stiffening members 54, 56, 58, 60. The stiffening members 54, 56, 58, 60 are flexile stiffening members and they may be stiffening members which are known as stringers.

Each stiffening member 54, 56, 58, 60 comprises a first strip 62 and a second strip 64. The second strip 64 is wider than the first strip 62 and it overlays the first strip 62. The first and second strips 62, 64 may be stuck together by an adhesive. By way of example, it is mentioned that the first strip 62 may be 50 mm wide, and the second strip 64 may be 80 mm wide. Other widths for the first and second strips 62, 64 may be employed.

Figure 12:
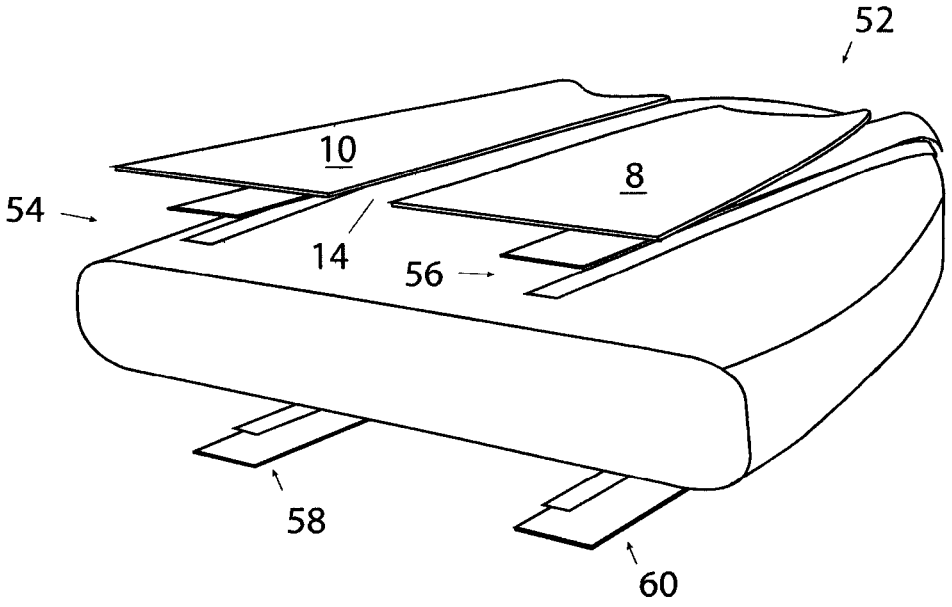
FIG. 12 is a section through the stand-up inflatable paddle board as shown in FIG. 11.
Figure 13:
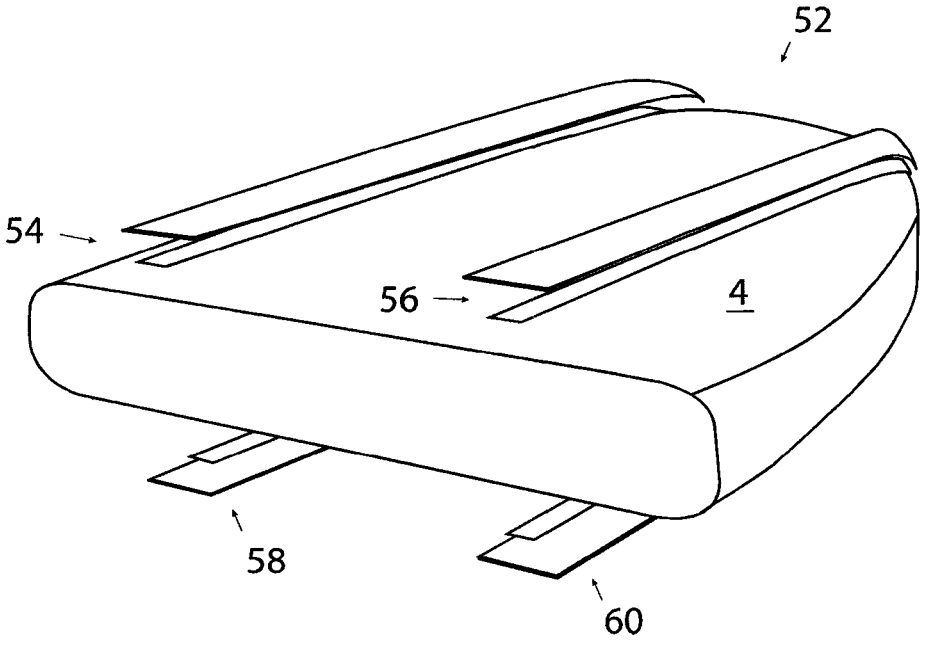
FIG. 13 is a section through the stand-up inflatable paddle board as shown in FIG. 12 but with some component parts omitted in order to illustrate more clearly other component parts.

As can best be appreciated from FIG. 12, there is one of the stiffening members 54, 56 on either side of the gap 14 on a top side of the stand-up inflatable paddle board 52, and there is one of the stiffening members 58, 60 on either side of the gap 52 on the underside of the stand-up inflatable paddle board 52. The stiffening members 58, 60 on the underside of the stand-up inflatable paddle board 52 are in line with the stiffening members 54, 56 respectively on the top side of the stand-up inflatable paddle board 52. The stiffening members 54, 56, 58, 60 may be stuck to their surfaces of the stand-up inflatable paddle board 52 by any suitable adhesive, for example one of the adhesives currently used for securing known stiffening members to known stand-up inflatable paddle boards.

It to be appreciated that the embodiments of the invention described above with reference to the accompanying drawings have been given by way of example only and that modifications may be effected. Thus, for example, the deck pads 8 may be longer or shorter than shown. The valve 6 may be provided at other positions on the stand-up inflatable paddle boards 2, 26, 28. Other types of indicator means 12 may be employed to those shown and described above. More than two fins 16, 18 may be employed in which case the fins may be employed in various configurations. A single fin may also be employed if desired. Individual components shown in the drawings are not limited to use in their drawings and they may be used in other drawings and in all aspects of the invention.

The invention claimed is:

1. A stand-up inflatable paddle board which is for a single user and which comprises:

(i) a deck;

(ii) a valve for enabling the stand-up inflatable paddle board to be inflated and deflated;

(iii) indicator means for indicating that the stand-up inflatable paddle board requires at least one fold which is longitudinal when the stand-up inflatable paddle board is to be placed in a deflated condition; and (iv) at least one pair of deck pads for receiving the user of the stand-up inflatable paddle board, and wherein the deck pads extend longitudinally of the deck, and the stand-up inflatable paddle board being such that:

(v) the deck has a top side and an underside;

(vi) the top side and the underside are such that water cannot pass through the deck from the underside to the top side;

(vii) the deck has a front portion which curves upwardly in use of the stand-up inflatable paddle board; and (viii) the deck pads are spaced apart by a longitudinal gap which permits the fold to be effected about the gap.

2. A stand-up inflatable paddle board according to claim 1 in which there is one pair of the deck pads, and in which the gap extends along a longitudinal central axis of the stand-up inflatable paddle board.

3. A stand-up inflatable paddle board according to claim 1 in which there are two pairs of the deck pads, and in which the two pairs of the deck pads are symmetrically disposed about a longitudinal central axis of the stand-up inflatable paddle board.

4. A stand-up inflatable paddle board according to claim 1 in which the indicator means is on the deck.

5. A stand-up inflatable paddle board according to claim 1 in which the gap is configured to form the indicator means.

6. A stand-up inflatable paddle board according to claim 1 and including auxiliary indicator means which is on an underside of the stand-up inflatable paddle board in use of the stand-up inflatable paddle board.

7. A stand-up inflatable paddle board according to claim 6 in which the indicator means is on a top side of the stand-up inflatable paddle board, and in which the auxiliary indicator means is on the underside of the stand-up inflatable paddle board and in line with the indicator means.

8. A stand-up inflatable paddle board according to claim 1 and including at least one stiffening member for stiffening the stand-up inflatable paddle board when it is in an inflated condition for use.

9. A stand-up inflatable paddle board according to claim 8 in which there is at least one of the stiffening members on a top side of the stand-up inflatable paddle board, and at least one of the stiffening members on an underside of the stand-up inflatable paddle board.

10. A stand-up inflatable paddle board according to claim 8 in which there are at least two of the stiffening members positioned one on either side of the indicator means.

11. A stand-up inflatable paddle board according to claim 10 in which there are the same number of stiffening members on the underside of the stand-up inflatable paddle board as there are on the top side of the stand-up inflatable paddle board.

12. A stand-up inflatable paddle board according to claim 8 in which the or each stiffening member is made of a flexible material.

13. A stand-up inflatable paddle board according to claim 1 in which the valve is positioned on a left side of the deck.

14. A stand-up inflatable paddle board according to claim 1 in which the valve is positioned on a right side of the deck.

15. A stand-up inflatable paddle board according to claim 1 and including anchor means on the deck for enabling goods to be secured on the deck.

16. A stand-up inflatable paddle board according to claim 15 which the anchor means comprises a plurality of eyelets.

17. A stand-up inflatable paddle board according to claim 1 in which the stand-up inflatable paddle board is made of a drop stitch material.

18. A stand-up inflatable paddle board according to claim 1 and including at least one of a handle which is off-set from the fold and a pair of fins which are off-set from the fold.

* * * * *